US011526113B2

(12) United States Patent
Hashimoto

(10) Patent No.: US 11,526,113 B2
(45) Date of Patent: Dec. 13, 2022

(54) IMAGE FORMING APPARATUS

(71) Applicant: BROTHER KOGYO KABUSHIKI KAISHA, Nagoya (JP)

(72) Inventor: Yohei Hashimoto, Nagakute (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/487,050

(22) Filed: Sep. 28, 2021

(65) Prior Publication Data

US 2022/0100139 A1 Mar. 31, 2022

(30) Foreign Application Priority Data

Sep. 30, 2020 (JP) ..... JP2020-165975

(51) Int. Cl.
*G03G 15/00* (2006.01)

(52) U.S. Cl.
CPC ..... *G03G 15/757* (2013.01)

(58) Field of Classification Search
CPC ..... G03G 15/757
See application file for complete search history.

(56) References Cited

U.S. PATENT DOCUMENTS 9,363,398 B2 * 6/2016 Xu ..... H04N 1/024
2010/0104311 A1 * 4/2010 Okamoto ..... G03G 15/6511 399/75
2011/0180985 A1 * 7/2011 Yamamoto ..... B65H 3/0607 271/117
2014/0016957 A1 1/2014 Suzuki et al.
2017/0152116 A1 * 6/2017 Hashimoto ..... G03G 15/6529
2021/0200135 A1 * 7/2021 Ikegami ..... G03G 15/0808
2021/0200140 A1 * 7/2021 Sano ..... G03G 15/0121

FOREIGN PATENT DOCUMENTS

JP 2014-21195 A 2/2014
JP 2020124863 A * 8/2020

* cited by examiner

*Primary Examiner* — Sevan A Aydin
(74) *Attorney, Agent, or Firm* — Merchant & Gould P.C.

(57) ABSTRACT

A conveyance roller is configured to convey a sheet having passed through a fixing device toward a photosensitive drum. A gear train is switchable between a transmission state in which the gear train transmits power from a motor to the conveyance roller and a transmission release state in which the gear train does not transmit the power from the motor to the conveyance roller. A movement member is movable between a first position at which the movement member causes the gear train to be in the transmission state and a second position at which the movement member causes the gear train to be in the transmission release state. A cam is configured to cause a development roller to move between a contact position and a separation position. The movement member is movable between the first position and the second position in conjunction with movement of the cam.

15 Claims, 9 Drawing Sheets

IMAGE FORMING APPARATUS

CROSS REFERENCE TO RELATED APPLICATIONS

This application claims priority from Japanese Patent Application No. 2020-165975 filed Sep. 30, 2020. The entire content of the priority application is incorporated herein by reference.

BACKGROUND

Conventionally, an image forming apparatus includes a photosensitive drum, a fixing device, a conveyance roller, and a gear train. When the image forming apparatus prints on both sides of a sheet, the conveyance roller conveys the sheet that has passed through the fixing device toward the photosensitive drum. The gear train transmits power from the motor to the conveyance roller.

SUMMARY

According to one aspect, this specification discloses an image forming apparatus. The image forming apparatus includes a photosensitive drum, a development roller, a fixing device, a conveyance roller, a motor, a gear train, a movement member, and a cam. The development roller is movable between a contact position at which the development roller contacts the photosensitive drum and a separation position at which the development roller is separated from the photosensitive drum. The fixing device is configured to fix toner on a sheet. The conveyance roller is configured to convey the sheet having passed through the fixing device toward the photosensitive drum. The gear train is switchable between a transmission state in which the gear train transmits power from the motor to the conveyance roller and a transmission release state in which the gear train does not transmit the power from the motor to the conveyance roller. The movement member is movable between a first position at which the movement member causes the gear train to be in the transmission state and a second position at which the movement member causes the gear train to be in the transmission release state. The cam is configured to cause the development roller to move between the contact position and the separation position. The movement member is movable between the first position and the second position in conjunction with movement of the cam. According to the above configuration, the movement member is moved between the first position and the second position by using the cam that causes the development roller to move between the contact position and the separation position.

BRIEF DESCRIPTION OF THE DRAWINGS

Embodiments in accordance with this disclosure will be described in detail with reference to the following figures wherein.

DETAILED DESCRIPTION

Figure 1:
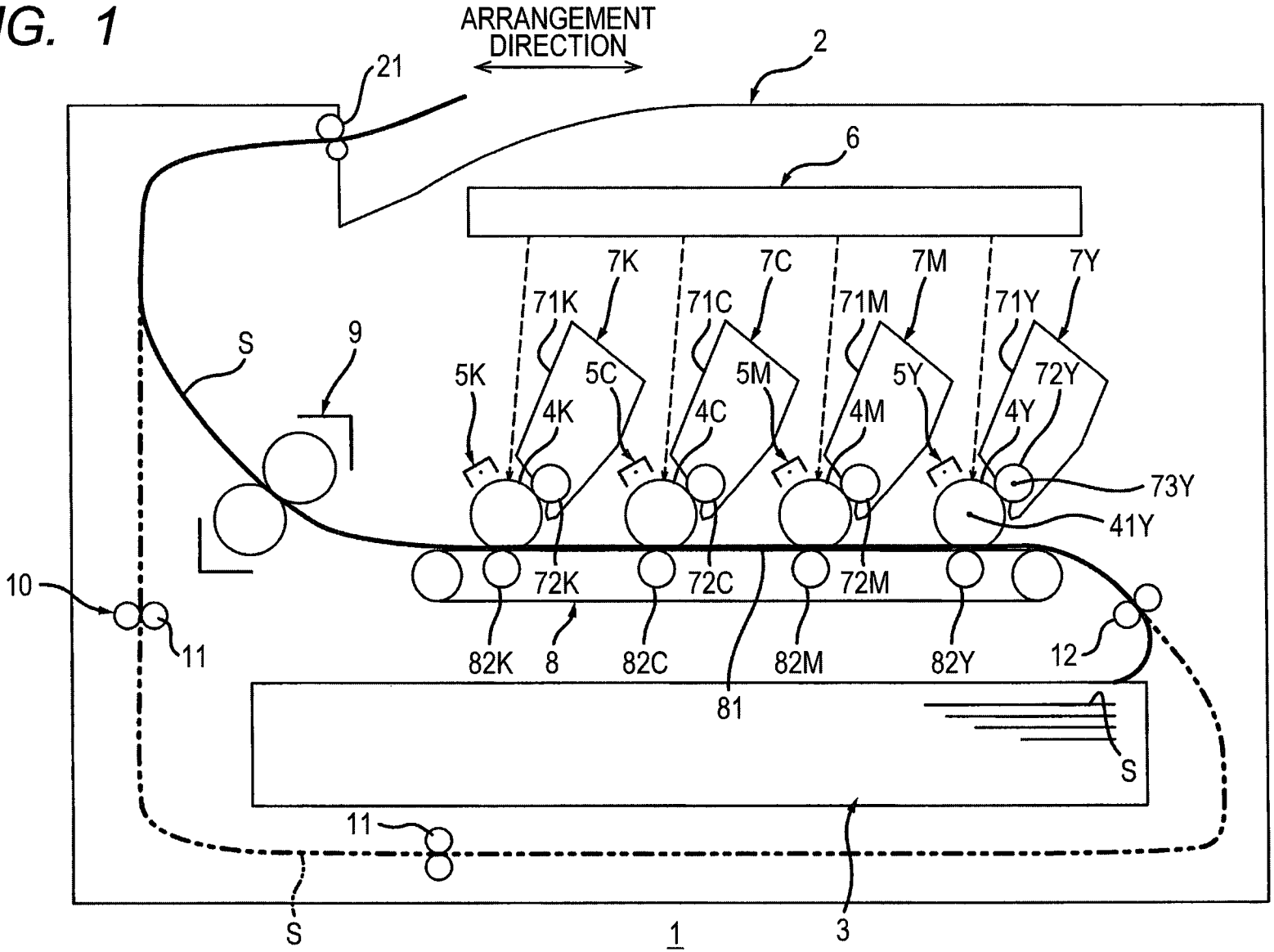
FIG. 1 is a diagram showing the schematic configuration of an image forming apparatus in a multicolor print mode.

In the above-mentioned image forming apparatus, the conveyance roller rotates even when the conveying roller need not rotate, for example, when the image forming apparatus prints on only one side of a sheet.

Thus, in order to stop the rotation of the conveyance roller when the conveyance roller need not rotate, it is desired to provide a mechanism for stopping transmission of driving force to the conveyance roller. Further, it is desired to provide such a mechanism in a small space while suppressing an increase in cost.

In view of the foregoing, an aspect of an objective of this disclosure is to provide an image forming apparatus configured to stop transmission of driving force to a conveyance roller in a small space while suppressing an increase in cost.

1. Outline of Image Forming Apparatus 1

The outline of an image forming apparatus 1 will be described with reference to FIG. 1.

The image forming apparatus 1 includes a main housing 2, a sheet accommodating portion 3, a plurality of photosensitive drums 4Y, 4M, 4C, 4K, a plurality of charging devices 5Y, 5M, 5C, 5K, an exposure device 6, a plurality of development devices 7Y, 7M, 7C, 7K, a transfer device 8, and a fixing device 9.

1.1 Main Housing 2

The main housing 2 accommodates the sheet accommodating portion 3, the plurality of photosensitive drums 4Y, 4M, 4C, 4K, the plurality of charging devices 5Y, 5M, 5C, 5K, the exposure device 6, the plurality of development devices 7Y, 7M, 7C, 7K, the transfer device 8, and the fixing device 9.

1.2 Sheet Accommodating Portion 3

The sheet accommodating portion 3 accommodates a sheet S. The sheet S in the sheet accommodating portion 3 is conveyed toward the photosensitive drum 4Y.

1.3 Photosensitive Drums 4Y, 4M, 4C, 4K

The photosensitive drums 4Y, 4M, 4C, 4K are arranged in an arrangement direction.

The photosensitive drum 4Y extends in an axial direction. The axial direction crosses the arrangement direction. The axial direction may be perpendicular to the arrangement direction. The photosensitive drum 4Y is rotatable about a first axis 41Y. The first axis 41Y extends in the axial direction.

The description of each of the photosensitive drums 4M, 4C, and 4K is the same as the description of the photosensitive drum 4Y. Thus, the description of each of the photosensitive drums 4M, 4C, and 4K will be omitted.

1.4 Charging Devices 5Y, 5M, 5C, 5K

The charging device 5Y charges the photosensitive drum 4Y. The charging device 5M charges the photosensitive drum 4M. The charging device 5C charges the photosensitive drum 4C. The charging device 5K charges the photosensitive drum 4K. Each of the charging devices 5Y, 5M, 5C, and 5K is a scorotron charger. Each of the charging devices 5Y, 5M, 5C, and 5K may be a charging roller.

1.5 Exposure Device 6

The exposure device 6 exposes the circumferential surface of each of the photosensitive drums 4Y, 4M, 4C, and 4K. In this embodiment, the exposure device 6 is a laser scan unit. The exposure device may be an exposure head having an LED array.

1.6 The Development Devices 7Y, 7M, 7C, 7K

The development device 7Y supplies toner to the photosensitive drum 4Y. The development device 7Y includes a development housing 71Y and a development roller 72Y. That is, the image forming apparatus 1 includes the development roller 72Y.

The development housing 71Y accommodates the toner to be supplied to the photosensitive drum 4Y.

The development roller 72Y is attached to the development housing 71Y. The development roller 72Y extends in the axial direction. The development roller 72Y is rotatable about a second axis 73Y. The second axis 73Y extends in the axial direction.

Figure 2:
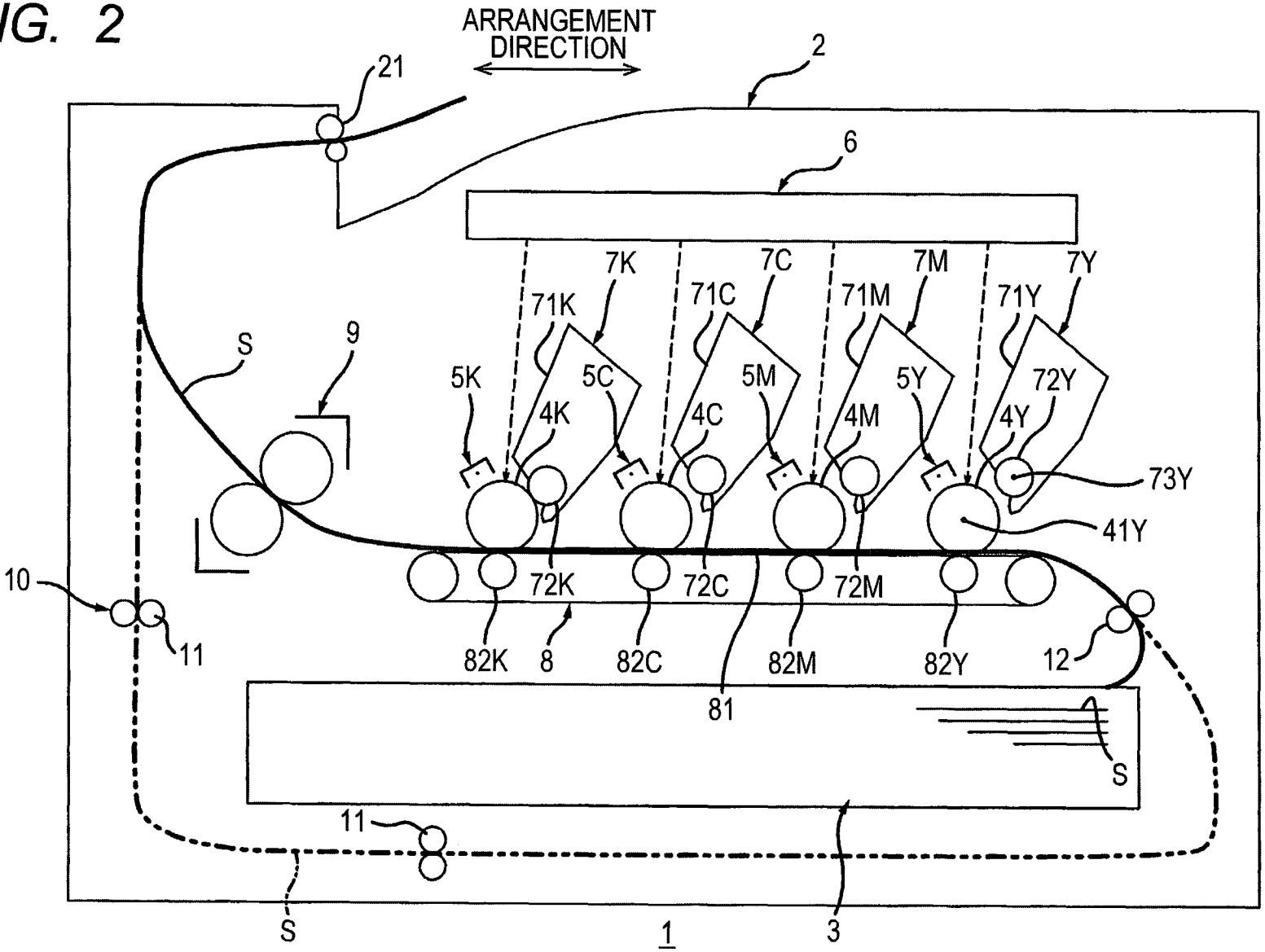
FIG. 2 shows the image forming apparatus shown in FIG. 1 in a single color print mode.

The development roller 72Y is movable between a contact position (see FIG. 1) and a separation position (see FIG. 2). In the present embodiment, the development roller 72Y is movable between the contact position and the separation position together with the development housing 71Y. In a state where the development roller 72Y is located at the contact position, the development roller 72Y contacts the photosensitive drum 4Y. In a state where the development roller 72Y is located at the contact position, the development roller 72Y supplies the toner in the development housing 71Y to the photosensitive drum 4Y. In a state where the development roller 72Y is located at the separation position, the development roller 72Y is separated from the photosensitive drum 4Y.

Figure 3:
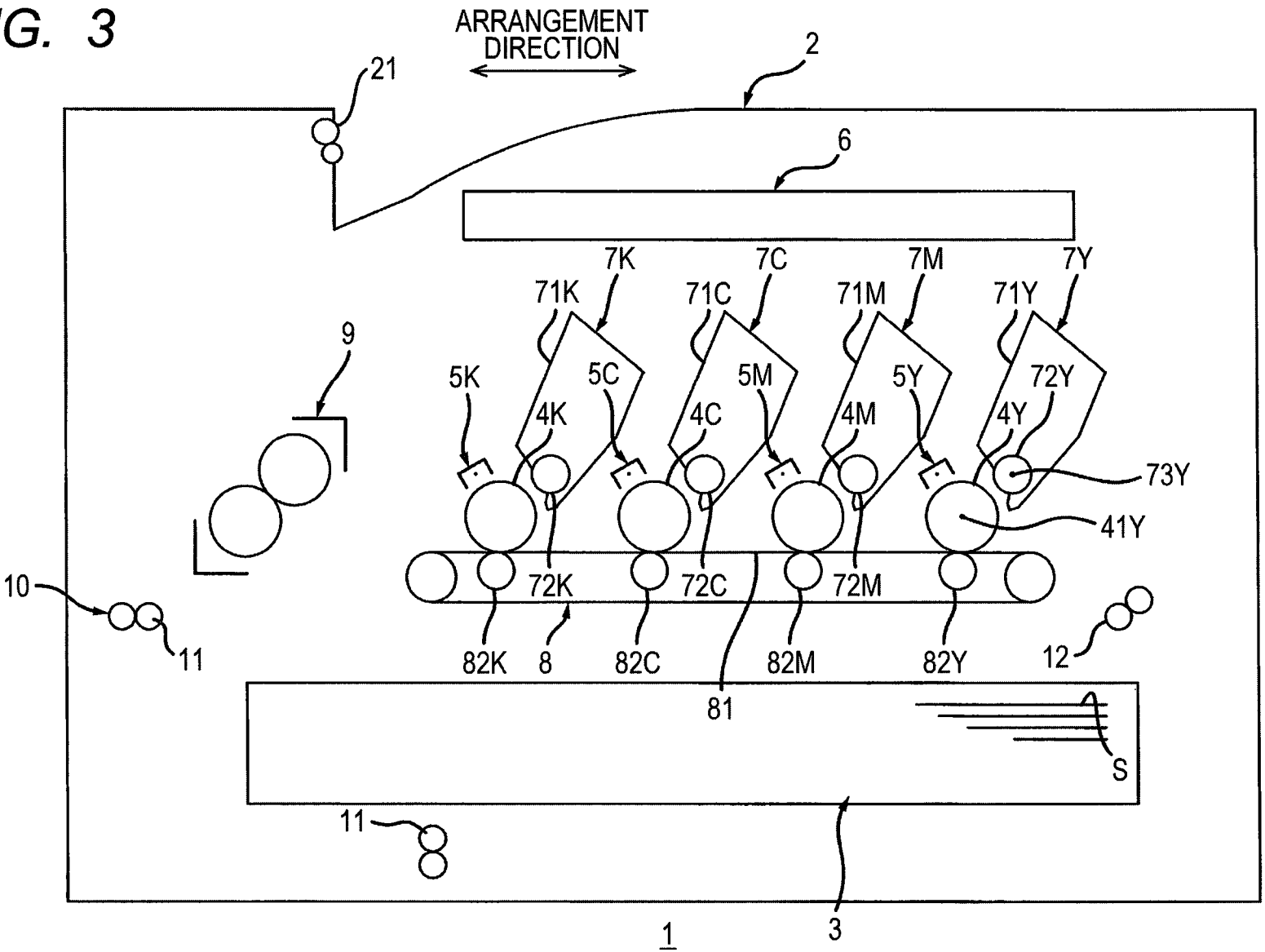
FIG. 3 shows the image forming apparatus shown in FIG. 1 in which all development rollers and photosensitive drums are separated from each other.

The description of each of the development devices 7M, 7C, and 7K is the same as the description of the development device 7Y. That is, the image forming apparatus 1 includes a development roller 72K. The development roller 72K is movable between a second contact position (see FIG. 1) and a second separation position (see FIG. 3). In a state where the development roller 72K is located at the second contact position, the development roller 72K contacts the photosensitive drum 4K. In a state where the development roller 72K is located at the second separation position, the development roller 72K is separated from the photosensitive drum 4K. The description of each of the development devices 7M, 7C, and 7K will be omitted.

In the following description, as shown in FIG. 1, a multicolor print mode refers to a state where the development roller 72Y contacts the photosensitive drum 4Y, the development roller 72M contacts the photosensitive drum 4M, the development roller 72C contacts the photosensitive drum 4C, and the development roller 72K contacts the photosensitive drum 4K. As shown in FIG. 2, a single-color print mode refers to a state where the development roller 72Y is separated from the photosensitive drum 4Y, the development roller 72M is separated from the photosensitive drum 4M, the development roller 72C is separated from the photosensitive drum 4C, and the development roller 72K contacts the photosensitive drum 4K.

1.7 Transfer Device 8

As shown in FIG. 1, when the image forming apparatus 1 is in the multicolor print mode, the transfer device 8 transfers the toner on each of the photosensitive drums 4Y, 4M, 4C, and 4K to the sheet S. Specifically, the transfer device 8 includes a belt 81 and a plurality of transfer rollers 82Y, 82M, 82C, 82K.

The belt 81 contacts each of the photosensitive drums 4Y, 4M, 4C, and 4K. The belt 81 conveys the sheet S from the sheet accommodating portion 3 toward the fixing device 9.

The transfer roller 82Y transfers the toner on the photosensitive drum 4Y to the sheet S conveyed by the belt 81. The transfer roller 82M transfers the toner on the photosensitive drum 4M to the sheet S conveyed by the belt 81. The transfer roller 82C transfers the toner on the photosensitive drum 4C to the sheet S conveyed by the belt 81. The transfer roller 82K transfers the toner on the photosensitive drum 4K to the sheet S conveyed by the belt 81.

1.8 Fixing Device 9

The fixing device 9 heats and pressurizes the sheet S on which the toner is transferred to fix the toner on the sheet S. When the sheet S that has passed through the fixing device 9 does not enter a reconveyance path 10, the sheet S is discharged to the upper surface of the main housing 2. The reconveyance path 10 will be described later.

2. Details of Image Forming Apparatus 1

As shown in FIG. 1, the image forming apparatus 1 has the reconveyance path 10. That is, the reconveyance path 10 is formed in the main housing 2. The image forming apparatus 1 includes a plurality of conveyance rollers 11, a registration roller 12, a motor 13 (see FIG. 4), a gear train 14 (see FIG. 4), a movement member 15 (see FIG. 4), and a spring 16 (see FIG. 4), a plurality of first separation levers 17Y, 17M, 17C, 17K, a plurality of second separation levers 18Y, 18M, 18C, 18K, a cam 19 (see FIG. 4), and a second gear train 20 (See FIG. 4). The plurality of first separation levers 17Y, 17M, 17C, 17K and the plurality of second separation levers 18Y, 18M, 18C, 18K are an example of a lever mechanism.

2.1 Reconveyance Path 10

The reconveyance path 10 is a path through which the sheet S is conveyed from the fixing device 9 to the photosensitive drum 4Y. Specifically, when the image forming apparatus 1 prints on both sides of the sheet S, printing is performed on the first side of the sheet S and the sheet S passes through the fixing device 9, and then the conveyance direction is changed by a discharge roller 21 and so on, so that the sheet S enters the reconveyance path 10 in a state where the trailing end of the sheet S is changed to the leading end. The sheet S that has entered the reconveyance path 10 is conveyed to the registration roller 12 through the reconveyance path 10.

2.2 Conveyance Roller 11

The plurality of conveyance rollers (reconveyance rollers) 11 are located at the reconveyance path 10. Each of the plurality of conveyance rollers 11 conveys the sheet S that has passed through the fixing device 9 toward the photosensitive drum 4Y. Specifically, each of the plurality of conveyance rollers 11 conveys the sheet S that has passed through the fixing device 9 toward the registration roller 12.

2.3 Registration Roller 12

The registration roller 12 temporarily stops the sheet S fed from the sheet accommodating portion 3 or the sheet S that passes through the reconveyance path 10, and conveys the sheet S toward the photosensitive drum 4Y.

2.4 Motor 13

Figure 4:
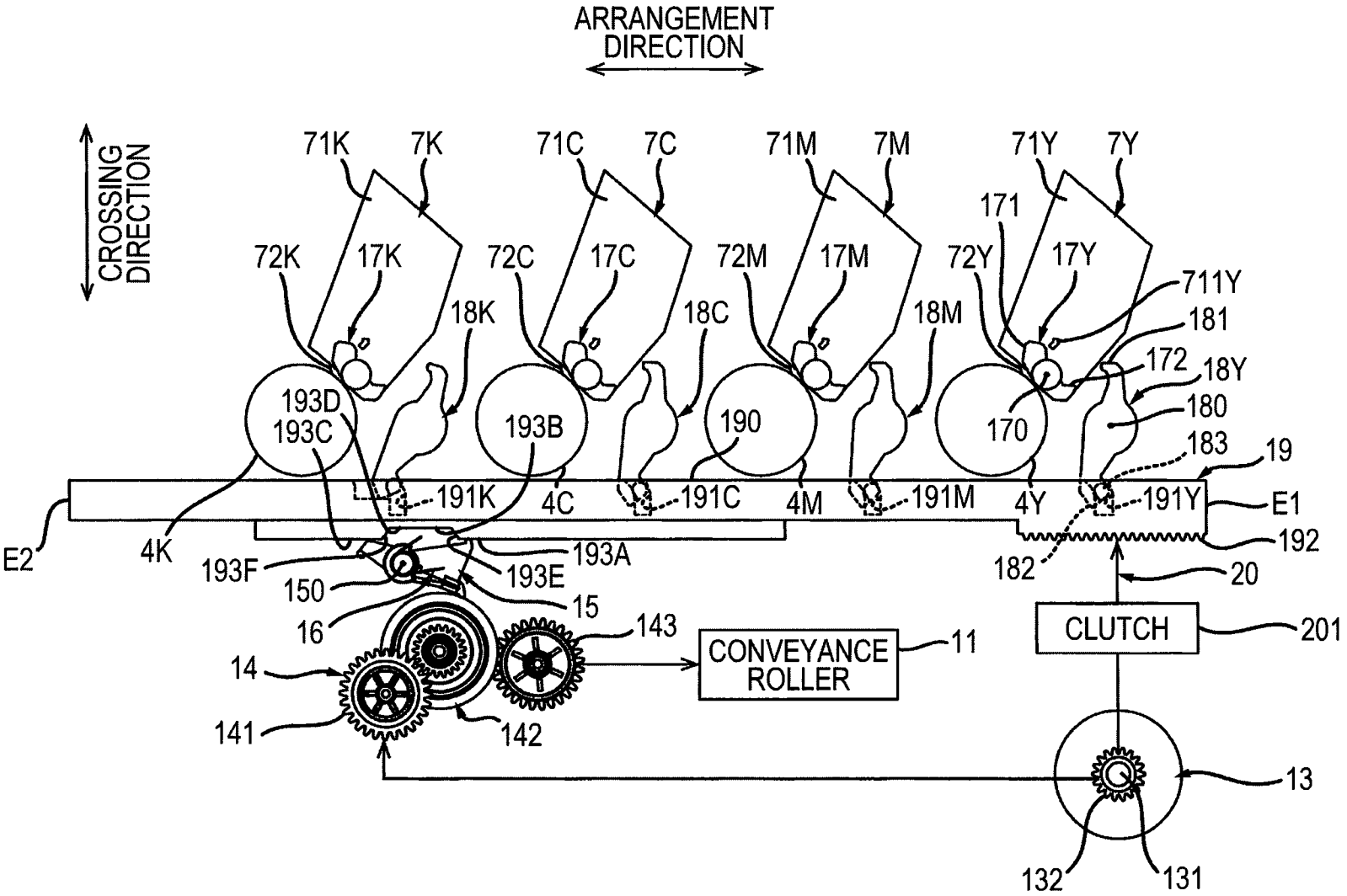
FIG. 4 is an explanatory diagram for illustrating interlocking of a cam and a movement member, and shows a state where the cam is located at a first cam position.

As shown in FIG. 4, the motor 13 includes a shaft 131 and a gear 132. The gear 132 is rotatable together with the shaft 131. The motor 13 is located inside the main housing 2. Each of the conveyance rollers 11 and the registration roller 12 rotates in the same direction regardless of whether the motor 13 rotates the shaft 131 in a first direction or rotates in a second direction opposite the first direction. The discharge roller 21 rotates in a forward direction when the motor 13 rotates the shaft 131 in the first direction, whereas the discharge roller 21 rotates in a reverse direction when the motor 13 rotates the shaft 131 in the second direction. When an image is printed on the sheet S, the motor 13 rotates the shaft 131 in the first direction. Thus, when the image is printed on the sheet S, the gear 132 rotates in the first direction. When the sheet S that has passed through the fixing device 9 is conveyed to the photosensitive drum 4Y, the motor 13 rotates the shaft 131 in the second direction. Thus, when the sheet S that has passed through the fixing device 9 is conveyed to the photosensitive drum 4Y, the gear 132 rotates in the second direction. The second direction is the direction opposite the first direction. The gear 132 engages with the gear train 14.

2.5 Gear Train 14

The gear train 14 is located inside the main housing 2. The gear train 14 is switchable between a transmission state (see FIG. 4 or 6) and a transmission release state (see FIG. 5 or 7). When the gear train 14 is in the transmission state, the gear train 14 transmits the power from the motor 13 to each of the plurality of conveyance rollers 11. When the gear train 14 is in the transmission release state, the gear train 14 stops the transmission of power from the motor 13 to each of the plurality of conveyance rollers 11.

Specifically, the gear train 14 has an idle gear 141, a differential gear 142, and an idle gear 143.

2.5.1 Idle Gear 141

The idle gear 141 rotates by receiving power from the motor 13.

2.5.2 Differential Gear 142

Figure 8:
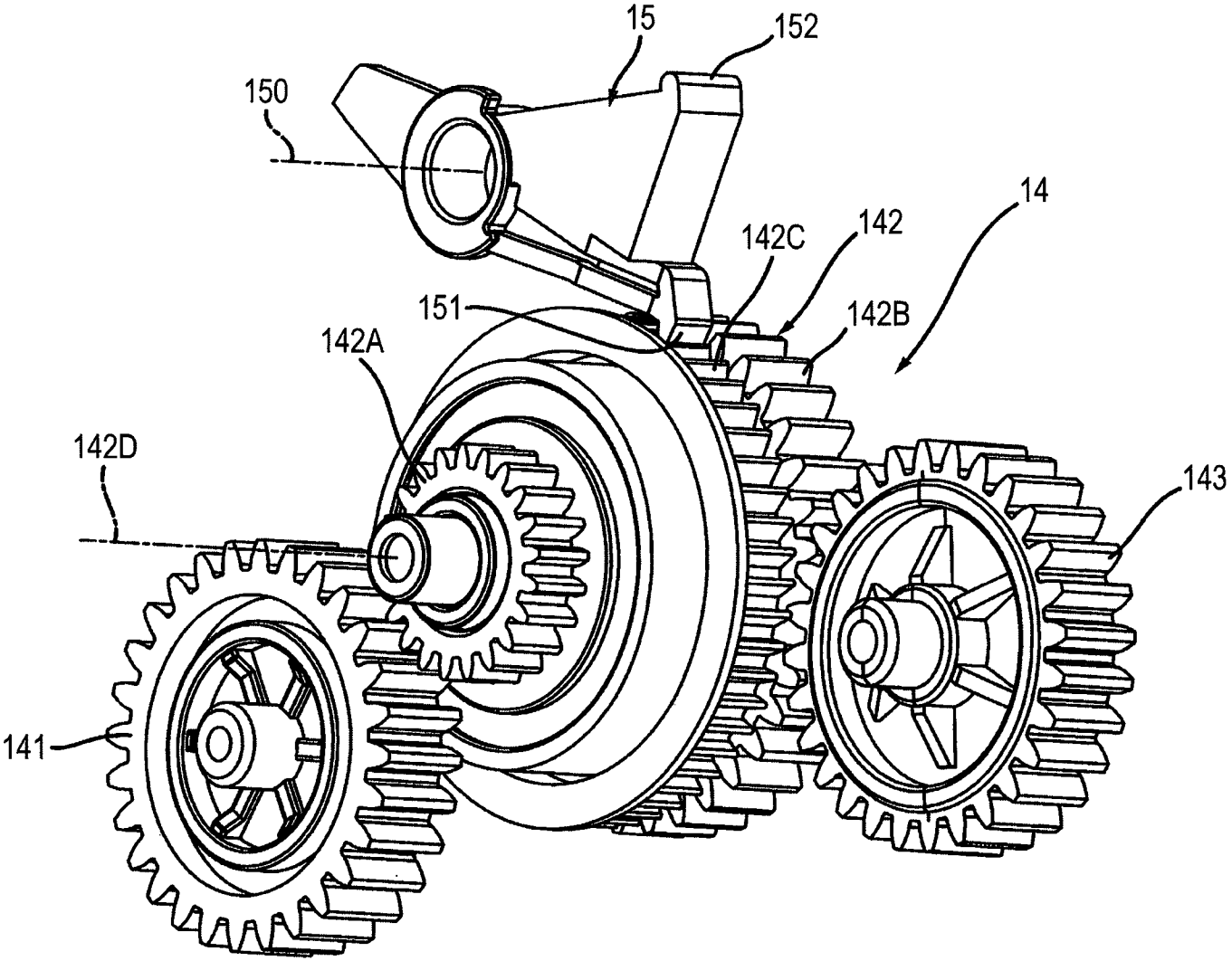
FIG. 8 is a perspective view of a gear train shown in FIG. 4.

The differential gear 142 has a planetary gear mechanism. As shown in FIG. 8, the differential gear 142 has a first gear 142A, a second gear 142B, and a third gear 142C.

The first gear 142A is rotatable together with the sun gear of the planetary gear mechanism. The first gear 142A engages with the idle gear 141. The first gear 142A is rotatable about an axis 142D. In the present embodiment, the axis 142D extends in the axial direction.

The second gear 142B is rotatable together with the planetary carrier of the planetary gear mechanism. The second gear 142B is located away from the first gear 142A in the direction in which the axis 142D extends. The second gear 142B is rotatable together with the first gear 142A in a state where the rotation of the third gear 142C is stopped. When the second gear 142B rotates together with the first gear 142A, the gear train 14 is put into the transmission state. In a state where the third gear 142C is rotating, the rotation of the second gear 142B is stopped. When the rotation of the second gear 142B is stopped, the gear train 14 is put into the transmission release state.

The third gear 142C is rotatable together with the ring gear of the planetary gear mechanism. The third gear 142C is located between the first gear 142A and the second gear 142B in the direction in which the axis 142D extends.

2.5.3 Idle Gear 143

The idle gear 143 engages with the second gear 142B of the differential gear 142. The idle gear 143 transmits power to each of the plurality of conveyance rollers 11 through a gear train (not shown).

2.6 Movement Member 15

As shown in FIG. 4, the movement member 15 is located inside the main housing 2. The movement member 15 is located between the gear train 14 and the cam 19. The movement member 15 is movable between a first position (see FIG. 4 or 6) and a second position (see FIG. 5 or 7). The movement member 15 is rotatable about an axis 150 between the first position and the second position. In the present embodiment, the axis 150 extends in the axial direction. In a state where the movement member 15 is located at the first position, the movement member 15 puts the gear train 14 into the transmission state. In a state where the movement member 15 is located at the second position, the movement member 15 puts the gear train 14 into the transmission release state.

Specifically, the movement member 15 is a lever. As shown in FIG. 8, the movement member 15 has a gear tooth 151 and a protrusion 152.

2.6.1 Gear Tooth 151

The gear tooth 151 is located away from the axis 150. In a state where the movement member 15 is located at the first position, the gear tooth 151 engages with the third gear 142C of the differential gear 142. When the gear tooth 151 engages with the third gear 142C of the differential gear 142, the rotation of the third gear 142C is stopped. As a result, the second gear 142B rotates together with the first gear 142A, and the gear train 14 is put into the transmission state. That is, in a state where the movement member 15 is located at the first position, the movement member 15 engages with the differential gear 142 to put the gear train 14 into the transmission state.

In a state where the movement member 15 is located at the second position (see FIG. 5 or 7), the gear tooth 151 is separated from the third gear 142C of the differential gear 142. When the gear tooth 151 is separated from the third gear 142C of the differential gear 142, the third gear 142C is rotatable. As a result, the rotation of the second gear 142B is stopped, and the gear train 14 is put into the transmission release state. That is, in a state where the movement member 15 is located at the second position, the movement member 15 is separated from the differential gear 142 to put the gear train 14 into the transmission release state.

2.6.2 Protrusion 152

The protrusion 152 is located away from the axis 150. The protrusion 152 is also located away from the gear tooth 151. The protrusion 152 is contactable with the cam surfaces 193A, 193B, 193C, 193D, 193E, and 193F (see FIG. 4) of the cam 19. The cam surfaces 193A, 193B, 193C, 193D, 193E, and 193F will be described later.

2.7 Spring 16

The spring 16 is located inside the main housing 2. The spring 16 presses the movement member 15 located at the first position toward the second position. The spring 16 is, for example, a torsion spring.

2.8 First Separation Levers 17Y, 17M, 17C, 17K

The first separation lever 17Y causes the development roller 72Y to separate from the photosensitive drum 4Y. Specifically, the first separation lever 17Y is movable between a first pressing position (see FIG. 6 or 7) and a first pressing release position (see FIG. 4 or 5). The first separation lever 17Y is rotationally movable about an axis 170 between the first pressing position and the first pressing release position. In the present embodiment, the axis 170 extends in the axial direction.

When the first separation lever 17Y moves from the first pressing release position to the first pressing position, the first separation lever 17Y presses the development housing 71Y in the direction in which the development roller 72Y is separated from the photosensitive drum 4Y. In a state where the first separation lever 17Y is located at the first pressing position, the development roller 72Y is located at the separation position.

When the first separation lever 17Y moves from the first pressing position to the first pressing release position, the first separation lever 17Y allows the protrusion 711Y of the development housing 71Y to move in the direction toward the photosensitive drum 4Y. In a state where the first separation lever 17Y is located at the first pressing release position, the development roller 72Y is located at the contact position.

As shown in FIG. 4, the first separation lever 17Y has a first end 171 and a second end 172. The first end 171 is located away from the axis 170. In a state where the first separation lever 17Y is located at the first pressing position (see FIG. 6 or 7), the first end 171 contacts the protrusion 711Y of the development housing 71Y. The second end 172 is located away from the axis 170 and the first end 171.

The description of the first separation levers 17M, 17C, and 17K is the same as that of the first separation lever 17Y. Thus, the description of the first separation levers 17M, 17C, and 17K will be omitted.

2.9 Second Separation Levers 18Y, 18M, 18C, 18K

The second separation lever 18Y causes the first separation lever 17Y to move from the first pressing release position to the first pressing position. Specifically, the second separation lever 18Y is movable between a second pressing position (see FIG. 6 or 7) and a second pressing release position (see FIG. 4 or 5). The second separation lever 18Y is rotationally movable about an axis 180 between the second pressing position and the second pressing release position. In the present embodiment, the axis 180 extends in the axial direction.

When the second separation lever 18Y moves from the second pressing release position to the second pressing position, the second separation lever 18Y presses the first separation lever 17Y from the first pressing release position toward the first pressing position. In a state where the second separation lever 18Y is located at the second pressing position, the first separation lever 17Y is located at the first pressing position.

When the second separation lever 18Y moves from the second pressing position to the second pressing release position, the second separation lever 18Y allows the first separation lever 17Y to move from the first pressing position to the first pressing release position. In a state where the second separation lever 18Y is located at the second pressing release position, the first separation lever 17Y is located at the first pressing release position.

As shown in FIG. 4, the second separation lever 18Y has a first end 181, a second end 182, and a protrusion 183. The first end 181 is located away from the axis 180. In a state where the second separation lever 18Y is located at the second pressing position (see FIG. 6 or 7), the first end 181 contacts the second end 172 of the first separation lever 17Y. The second end 182 is located away from the axis 180 and the first end 181. The protrusion 183 is located at the second end 182. The protrusion 183 extends in the direction in which the axis 180 extends.

The description of the second separation levers 18M, 18C, and 18K is the same as that of the second separation lever 18Y. Thus, the description of the second separation levers 18M, 18C, and 18K will be omitted.

2.10 Cam 19

The cam 19 is located inside the main housing 2. The cam 19 causes the development roller 72Y to move between the contact position and the separation position by moving the second separation lever 18Y between the second pressing position and the second pressing release position. The cam 19 causes the development roller 72Y to move between the contact position and the separation position, and causes the movement member 15 to move between the first position and the second position. That is, the movement member 15 is movable between the first position and the second position in conjunction with the movement of the cam 19.

Figure 6:
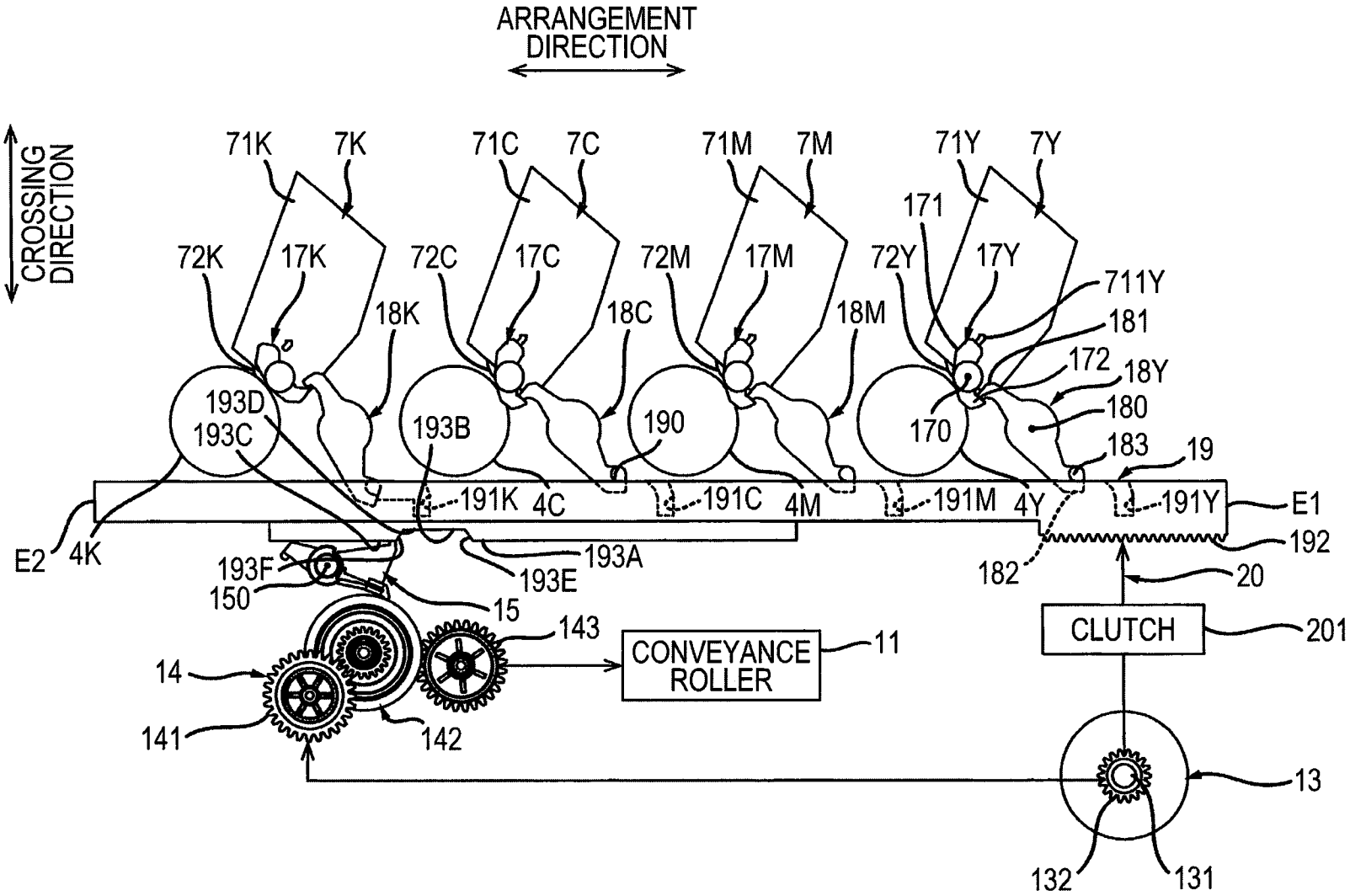
FIG. 6 is an explanatory diagram for illustrating the interlocking of the cam and the movement member, and shows a state where the cam is located at a third cam position.
Figure 7:
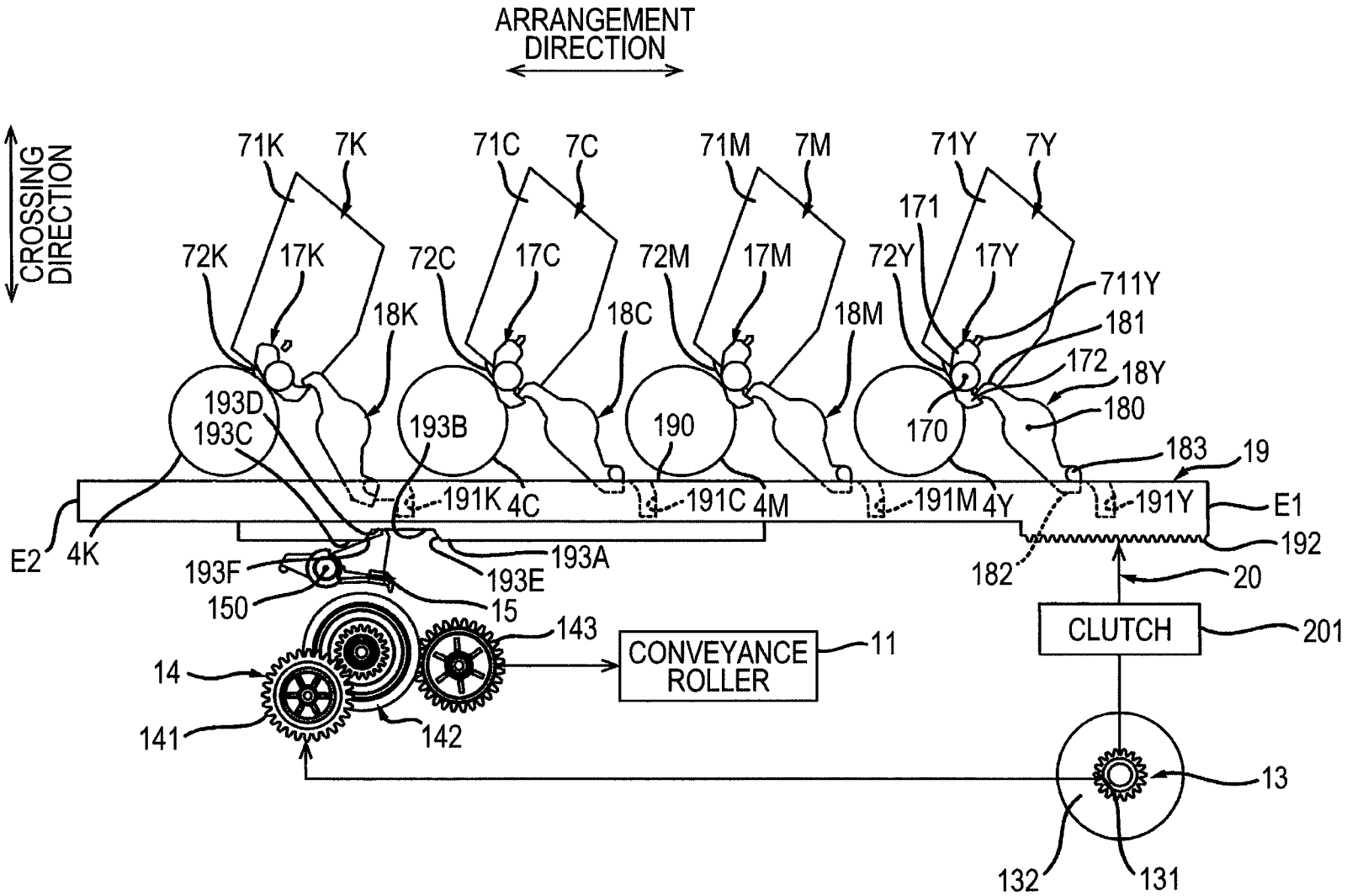
FIG. 7 is an explanatory diagram for illustrating the interlocking of the cam and the movement member, and shows a state where the cam is located at a fourth cam position.

The cam 19 is movable between a first cam position (see FIG. 4), a second cam position (see FIG. 5), a third cam position (see FIG. 6), and a fourth cam position (see FIG. 7). In the present embodiment, the cams 19 are movable in the arrangement direction. In a state where the cam 19 is located at the first cam position, the cam 19 causes the development roller 72Y to be located at the contact position and causes the movement member 15 to be located at the first position. In a state where the cam 19 located at the second cam position, the cam 19 causes the development roller 72Y to be located at the contact position and causes the movement member 15 to be located at the second position. In a state where the cam 19 located at the third cam position, the cam 19 causes the development roller 72Y to be located at the separation position and causes the movement member 15 to be located at the first position. In a state where the cam 19 located at the fourth cam position, the cam 19 causes the development roller 72Y to be located at the separation position and causes the movement member 15 to be located at the second position.

In the state where the cam 19 is located at the first cam position, the cam 19 is located at the second cam position, the cam 19 is located at the third cam position, and the cam 19 is located at the fourth cam position, the cam 19 causes the development roller 72K to be located at the second contact position.

The cam 19 extends in the movement direction of the cam 19. The cam 19 has a first end E1 and a second end E2 in the movement direction of the cam 19. The second end E2 is located away from the first end E1 in the movement direction of the cam 19. The cam 19 has a flat surface 190, a plurality of grooves 191Y, 191M, 191C, and 191K, a rack gear 192, and a plurality of cam surfaces 193A, 193B, 193C, 193D, 193E, and 193F.

2.10.1 Flat Surface 190

The flat surface 190 is the surface at one side of the cam 19 in the crossing direction. The crossing direction crosses the movement direction of the cam 19 and the axial direction. The crossing direction may be perpendicular to the movement direction of the cam 19 and the axial direction. The flat surface 190 extends in the movement direction of the cam 19.

As shown in FIGS. 6 and 7, in a state where the second separation lever 18Y is located at the second pressing position, the protrusion 183 of the second separation lever 18Y contacts the flat surface 190.

2.10.2 Grooves 191Y, 191M, 191C, 191K

The grooves 191Y, 191M, 191C, and 191K are located between the first end E1 and the second end E2 in the movement direction of the cam 19. The grooves 191Y, 191M, 191C, and 191K are arranged in the movement direction of the cam 19.

Figure 5:
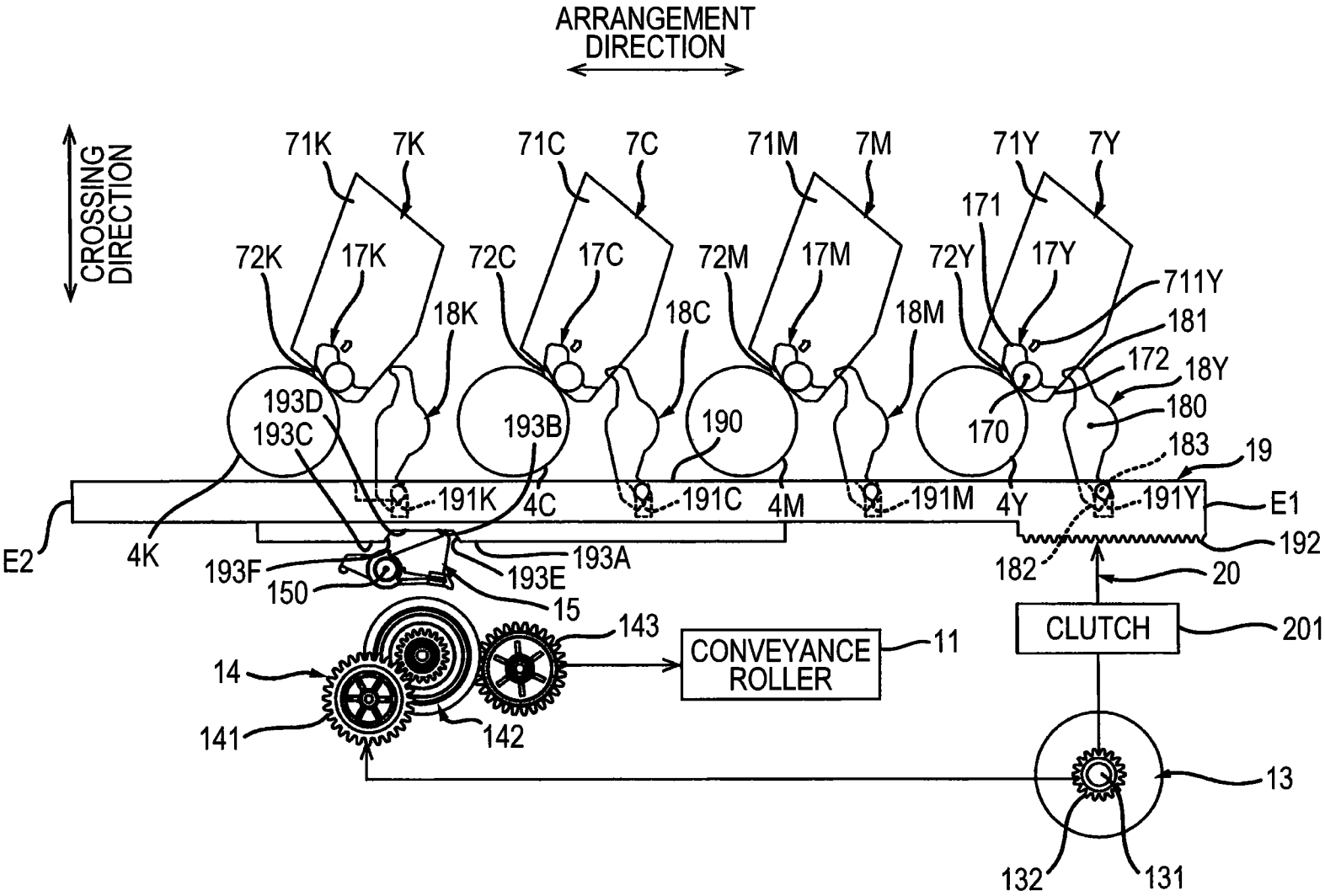
FIG. 5 is an explanatory diagram for illustrating the interlocking of the cam and the movement member, and shows a state where the cam is located at a second cam position.

As shown in FIGS. 4 and 5, the groove 191Y extends in the crossing direction. In a state where the second separation lever 18Y is located at the second pressing release position, the protrusion 183 of the second separation lever 18Y fits into the groove 191Y.

The description of the grooves 191M, 191C, and 191K is the same as the description of the groove 191Y. Thus, the description of the grooves 191M, 191C, and 191K will be omitted.

2.10.3 Rack Gear 192

The rack gear 192 is located at the first end E1 of the cam 19. The rack gear 192 extends in the movement direction of the cam 19.

2.10.4 Cam Surfaces 193A, 193B, 193C, 193D, 193E, 193F

The cam surfaces 193A, 193B, 193C, 193D, 193E, and 193F are surfaces at the other side of the cam 19 in the crossing direction. The cam surfaces 193A, 193B, 193C, 193D, 193E, and 193F are located away from the flat surface 190 in the crossing direction. The cam surfaces 193A, 193B, 193C, 193D, 193E, and 193F are arranged in the movement direction of the cam 19.

The cam surface 193A is located between the rack gear 192 and the second end E2 of the cam 19 in the movement direction of the cam 19. The cam surface 193A extends in the movement direction of the cam 19. The cam surface 193A is a flat surface. In a state where the cam 19 is located at the first cam position, the cam surface 193A causes the movement member 15 to be located at the first position. The cam surface 193A contacts the protrusion 152 of the movement member 15 in a state where the cam 19 is located at the first cam position and the movement member 15 is located at the first position.

The cam surface 193B is located away from the cam surface 193A in the movement direction of the cam 19. In the present embodiment, the cam surface 193B is located between the cam surface 193A and the second end E2 of the cam 19 in the movement direction of the cam 19. The cam surface 193B is located away from the cam surface 193A in the crossing direction. The cam surface 193B is located between the flat surface 190 and the cam surface 193A in the crossing direction. The cam surface 193B extends in the movement direction of the cam 19. The cam surface 193B is a flat surface. In a state where the cam 19 is located at the second cam position, the cam surface 193B allows the movement member 15 to be located at the second position. In the present embodiment, the cam surface 193B contacts the protrusion 152 of the movement member 15 in a state where the cam 19 is located at the second cam position and the movement member 15 is located at the second position. The cam surface 193B may face the protrusion 152 of the movement member 15 at an interval in a state where the cam 19 is located at the second cam position and the movement member 15 is located at the second position.

The cam surface 193C is located away from the cam surface 193A and the cam surface 193B in the movement direction of the cam 19. In the present embodiment, the cam surface 193C is located between the cam surface 193B and the second end E2 of the cam 19 in the movement direction of the cam 19. The cam surface 193C extends in the movement direction of the cam 19. The cam surface 193C is a flat surface. In a state where the cam 19 is located at the third cam position, the cam surface 193C causes the movement member 15 to be located at the first position. The cam surface 193C contacts the protrusion 152 of the movement member 15 in a state where the cam 19 is located at the third cam position and the movement member 15 is located at the first position.

The cam surface 193D is located away from the cam surface 193A, the cam surface 193B, and the cam surface 193C in the movement direction of the cam 19. In the present embodiment, the cam surface 193D is located between the cam surface 193B and the cam surface 193C in the movement direction of the cam 19. In the present embodiment, the cam surface 193D is continuous with the cam surface 193B. The cam surface 193D is located away from the cam surface 193C in the crossing direction. The cam surface 193D is located between the flat surface 190 and the cam surface 193C in the crossing direction. The cam surface 193D extends in the movement direction of the cam 19. The cam surface 193D is a flat surface. In a state where the cam 19 is located at the fourth cam position, the cam surface 193D allows the movement member 15 to be located at the second position. In the present embodiment, the cam surface 193D contacts the protrusion 152 of the movement member 15 in a state where the cam 19 is located at the fourth cam position and the movement member 15 is located at the second position. The cam surface 193D may face the protrusion 152 of the movement member 15 at an interval in a state where the cam 19 is located at the fourth cam position and the movement member 15 is located at the second position.

The cam surface 193E is located between the cam surface 193A and the cam surface 193B in the movement direction of the cam 19. The cam surface 193E is an inclined surface. The cam surface 193E is inclined with respect to the movement direction of the cam 19. One end of the cam surface 193E is connected to the cam surface 193A. The other end of the cam surface 193E is connected to the cam surface 193B.

The cam surface 193F is located between the cam surface 193C and the cam surface 193D in the movement direction of the cam 19. The cam surface 193F is an inclined surface. The cam surface 193F is inclined with respect to the movement direction of the cam 19. One end of the cam surface 193F is connected to the cam surface 193C. The other end of the cam surface 193F is connected to the cam surface 193D.

2.11 Second Gear Train 20

The second gear train 20 is located inside the main housing 2. The second gear train 20 transmits the power from the motor 13 to the rack gear 192 of the cam 19. As a result, the cam 19 is movable by the power from the motor 13. The second gear train 20 has a clutch 201.

The clutch 201 is switchable between a second transmission state and a second transmission release state. When the clutch 201 is in the second transmission state, the clutch 201 transmits power from the motor 13 to the cam 19. When the clutch 201 is in the second transmission release state, the clutch 201 stops the transmission of power from the motor 13 to the cam 19.

3. Operation of Image Forming Apparatus 1

Next, the operation of the image forming apparatus 1 will be described with reference to FIG. 1 and FIGS. 4 to 7.

3.1 Double-Sided Printing in Multi-Color Print Mode

As shown in FIG. 4, when the image forming apparatus 1 executes double-sided printing (duplex printing) in the multicolor print mode, the cam 19 is located at the first cam position. When the cam 19 is located at the first cam position, the movement member 15 is located at the first position. When the movement member 15 is located at the first position, the gear train 14 is put into the transmission state. As a result, the power from the motor 13 is transmitted to the plurality of conveyance rollers 11.

Next, as shown in FIG. 1, the image forming apparatus 1 forms an image on a first surface of the sheet S. At this time, the image forming apparatus 1 drives the motor 13 (see FIG. 4) and rotates the gear 132 (see FIG. 4) in the first direction in a state where the clutch 201 (see FIG. 4) is in the second transmission release state. Then, the image forming apparatus 1 stops the motor 13 (see FIG. 4) at the timing when the sheet S passes through the fixing device 9.

Next, the image forming apparatus 1 conveys the sheet S that has passed through the fixing device 9 to the registration roller 12 through the reconveyance path 10. At this time, the image forming apparatus 1 drives the motor 13 (see FIG. 4) and causes the gear 132 (see FIG. 4) to rotate in the second direction in a state where the clutch 201 (see FIG. 4) is in the second transmission release state. Then, the plurality of conveyance rollers 11 rotates, and the sheet S is conveyed toward the registration roller 12 through the reconveyance path 10. Then, when the sheet S reaches the registration roller 12, the image forming apparatus 1 stops the motor 13 (see FIG. 4).

Next, the image forming apparatus 1 forms an image on a second surface of the sheet S. The second surface is the surface opposite the first surface. At this time, the image forming apparatus 1 drives the motor 13 (see FIG. 4) and rotates the gear 132 (see FIG. 4) in the first direction in a state where the clutch 201 (see FIG. 4) is in the second transmission release state. Then, the sheet S in the reconveyance path 10 is conveyed toward the photosensitive drum 4Y by the registration roller 12.

The sheet S on which the images are formed on the first surface and the second surface is discharged to the upper surface of the main housing 2 as described above.

3.2 Single-Sided Printing in Multi-Color Print Mode

As shown in FIGS. 4 and 5, when switching from double-sided printing in the multicolor print mode (see FIG. 4) to single-sided printing in the multicolor print mode (see FIG. 5), the image forming apparatus 1 puts the clutch 201 into the second transmission state, and drives the motor 13 to rotate the gear 132 in the second direction. Then, the cam 19 moves from the first cam position to the second cam position. Then, the image forming apparatus 1 puts the clutch 201 into the second transmission release state and stops the motor 13 at the timing when the cam 19 is located at the second cam position. When the cam 19 is located at the second cam position, the movement member 15 is located at the second position. When the movement member 15 is located at the second position, the gear train 14 is in the transmission release state. As a result, the power from the motor 13 is not transmitted to the plurality of conveyance rollers 11.

Next, as shown in FIG. 1, the image forming apparatus 1 forms an image on the first surface of the sheet S. At this time, the image forming apparatus 1 drives the motor 13 (see FIG. 5), and rotates the gear 132 (see FIG. 5) in the first direction in a state where the clutch 201 (see FIG. 5) is in the second transmission release state.

The sheet S on which an image is formed on the first surface is discharged to the upper surface of the main housing 2 as described above.

3.3 Double-Sided Printing in Single-Color Print Mode

As shown in FIGS. 4 and 6, when switching from double-sided printing in the multicolor print mode (see FIG. 4) to double-sided printing in the single-color print mode (see FIG. 6), the image forming apparatus 1 puts the clutch 201 into the second transmission state, and drives the motor 13 to rotate the gear 132 in the second direction. That is, when the cam 19 moves from the first cam position to the third cam position, the motor 13 rotates in the second direction. Then, the image forming apparatus 1 puts the clutch 201 into the second transmission release state and stops the motor 13 at the timing when the cam 19 is located at the third cam position. When the cam 19 is located at the third cam position, the movement member 15 is located at the first position. When the movement member 15 is located at the first position, the gear train 14 is put into the transmission state. As a result, the power from the motor 13 is transmitted to the plurality of conveyance rollers 11.

Next, the image forming apparatus 1 forms an image on the first surface and the second surface of the sheet S in the same manner as the double-sided printing in the multicolor print mode.

3.4 Single-Sided Printing in Single-Color Print Mode

As shown in FIGS. 4 and 7, when switching from double-sided printing in the multicolor print mode (see FIG. 4) to single-sided printing in the single-color print mode (see FIG. 7), the image forming apparatus 1 puts the clutch 201 into the second transmission state, and drives the motor 13 to rotate the gear 132 in the second direction. Then, the image forming apparatus 1 puts the clutch 201 into the second transmission release state and stops the motor 13 at the timing when the cam 19 is located at the fourth cam position. When the cam 19 is located at the fourth cam position, the movement member 15 is located at the second position. When the movement member 15 is located at the second position, the gear train 14 is in the transmission release state. As a result, the power from the motor 13 is not transmitted to the plurality of conveyance rollers 11. Note that the development roller 72K is located at the contact position in a state where the cam is located at the first cam position (FIG. 4), in a state where the cam is located at the second cam position (FIG. 5), in a state where the cam is located at the third cam position (FIG. 6), and in a state where the cam is located at the fourth cam position (FIG. 7).

Next, the image forming apparatus 1 forms an image on the first surface of the sheet S in the same manner as the single-sided printing in the multicolor print mode.

4. Operations and Effects (1) According to the image forming apparatus 1, as shown in FIGS. 4 to 7, the movement member 15 is moved between the first position and the second position by using the cam 19 that causes the development roller 72Y to move between the contact position and the separation position.

Thus, the transmission of the driving force to the plurality of conveyance rollers 11 is stopped by a simple configuration including the movement member 15 movable between the first position and the second position, while suppressing the increase in the number of parts.

As a result, it is possible to stop the transmission of the driving force to the plurality of conveyance rollers 11 in a small space while suppressing the increase in cost.

(2) According to the image forming apparatus 1, as shown in FIG. 5 or 7, when the image forming apparatus 1 prints on only one side of the sheet S, the cam 19 is located at the second cam position (see FIG. 5) or the fourth cam position (see FIG. 7) so that the rotations of the plurality of conveyance rollers 11 are stopped.

(3) According to the image forming apparatus 1, as shown in FIG. 4, the cam surface 193B and the cam surface 193D are continuous with each other.

Thus, as shown in FIGS. 5 and 7, the cam 19 is moved between the second cam position (see FIG. 5) and the fourth cam position (see FIG. 7) without moving the movement member 15.

As a result, when the cam 19 is moved between the second cam position and the fourth cam position, the cam 19 is smoothly moved.

In other words, the cam 19 is smoothly moved when switching between single-sided printing in the multicolor print mode (see FIG. 5) and single-sided printing in the single-color print mode (see FIG. 7).

5. Modification

While the disclosure has been described in detail with reference to the above aspects thereof, it would be apparent to those skilled in the art that various changes and modifications may be made therein without departing from the scope of the claims.

Figure 9:
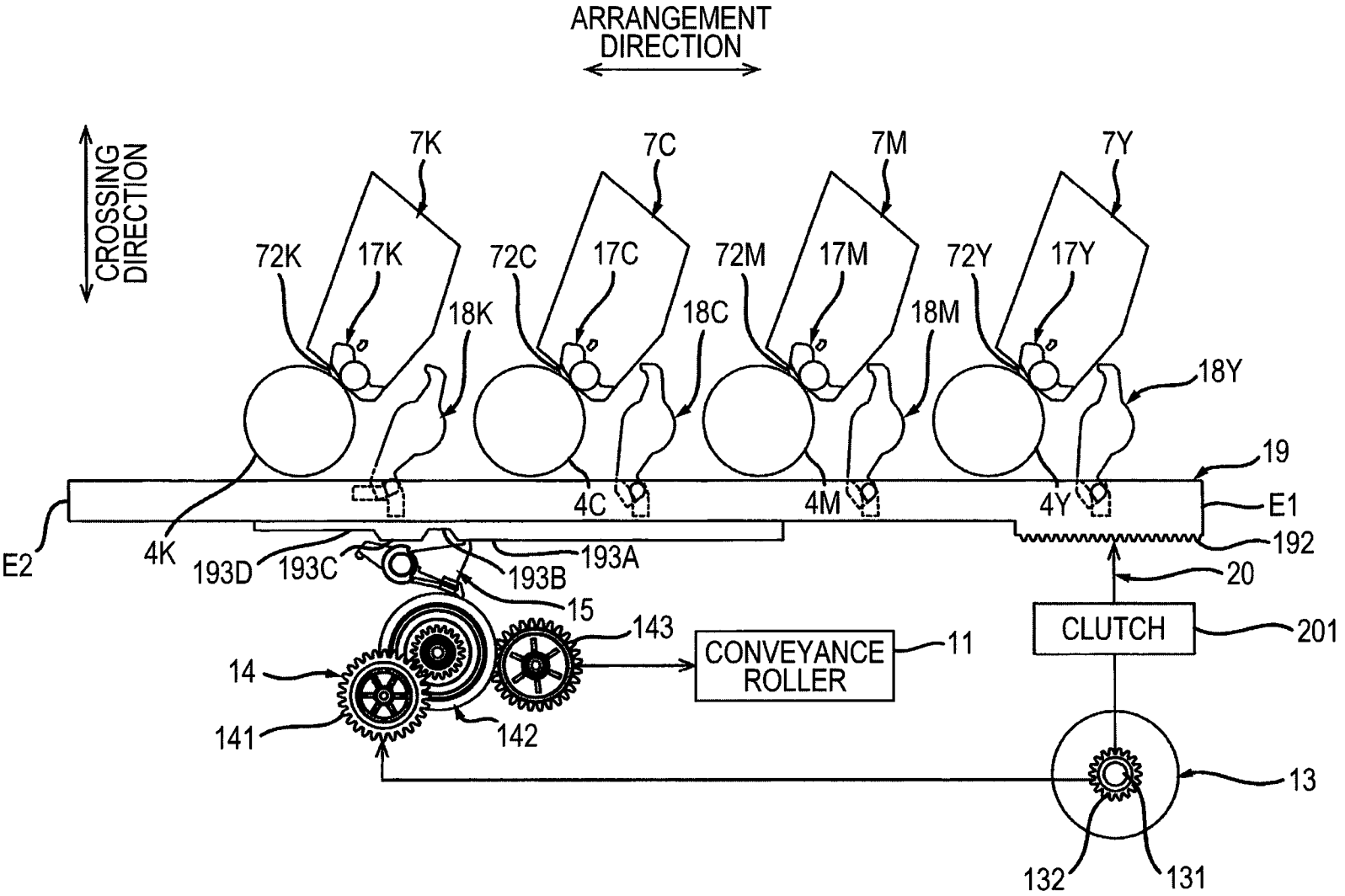
FIG. 9 is an explanatory diagram for illustrating a modification.

As shown in FIG. 9, the cam surface 193B and the cam surface 193D may not be continuous with each other. The cam surface 193C may be located between the cam surface 193B and the cam surface 193D.

In the above-described embodiment, the belt 81 of the transfer device 8 is a belt of a direct-transfer type in which a toner image is transferred to the sheet S that is conveyed between the belt 81 and the photosensitive drums 4Y-4K. Alternatively, the belt may be an intermediate-transfer type in which a toner image is temporarily transferred to the belt and then the toner image on the belt is transferred to the sheet S.

What is claimed is:

1. An image forming apparatus comprising:

a photosensitive drum;

a development roller movable between a contact position at which the development roller contacts the photosensitive drum and a separation position at which the development roller is separated from the photosensitive drum;

a fixing device configured to fix toner on a sheet;

a conveyance roller configured to convey the sheet having passed through the fixing device toward the photosensitive drum;

a motor;

a gear train switchable between a transmission state in which the gear train transmits power from the motor to the conveyance roller and a transmission release state in which the gear train does not transmit the power from the motor to the conveyance roller;

a movement member movable between a first position at which the movement member causes the gear train to be in the transmission state and a second position at which the movement member causes the gear train to be in the transmission release state; and a cam configured to cause the development roller to move between the contact position and the separation position, the movement member being movable between the first position and the second position in conjunction with movement of the cam.

2. The image forming apparatus according to claim 1, wherein the cam is movable between:

a first cam position at which the cam causes the development roller to be located at the contact position and causes the movement member to be located at the first position;

a second cam position at which the cam causes the development roller to be located at the contact position and causes the movement member to be located at the second position;

a third cam position at which the cam causes the development roller to be located at the separation position and causes the movement member to be located at the first position; and a fourth cam position at which the cam causes the development roller to be located at the separation position and causes the movement member to be located at the second position.

3. The image forming apparatus according to claim 2, wherein the cam has:

a first cam surface configured to cause the movement member to be located at the first position in a state where the cam is located at the first cam position;

a second cam surface configured to allow the movement member to be located at the second position in a state where the cam is located at the second cam position;

a third cam surface configured to cause the movement member to be located at the first position in a state where the cam is located at the third cam position; and a fourth cam surface configured to allow the movement member to be located at the second position in a state where the cam is located at the fourth cam position.

4. The image forming apparatus according to claim 3, wherein the second cam surface is continuous with the fourth cam surface.

5. The image forming apparatus according to claim 3, wherein the cam extends in a movement direction of the cam; and wherein the first cam surface, the second cam surface, the third cam surface, and the fourth cam surface are arranged in the movement direction of the cam and extend in the movement direction of the cam.

6. The image forming apparatus according to claim 2, further comprising:

a second photosensitive drum; and a second development roller movable between a second contact position at which the second development roller contacts the second photosensitive drum and a second separation position at which the second development roller is separated from the second photosensitive drum, wherein the cam is configured to cause the second development roller to be located at the second contact position in a state where the cam is located at the first cam position, in a state where the cam is located at the second cam position, in a state where the cam is located at the third cam position, and in a state where the cam is located at the fourth cam position.

7. The image forming apparatus according to claim 2, further comprising a second gear train configured to transmit power from the motor to the cam, wherein the motor includes:

a shaft; and a gear rotatable together with the shaft, the gear engaging with the gear train, the gear being configured to:

rotate in a first direction when an image is printed on the sheet; and rotate in a second direction opposite the first direction when the sheet having passed through the fixing device is conveyed to the photosensitive drum; and wherein the gear rotates in the second direction when the cam moves from the first cam position to the third cam position.

8. The image forming apparatus according to claim 7, wherein the second gear train includes a clutch.

9. The image forming apparatus according to claim 1, wherein the gear train includes a differential gear;

wherein, in a state where the movement member is located at the first position, the movement member engages with the differential gear, thereby causing the gear train to be in the transmission state; and wherein, in a state where the movement member is located at the second position, the movement member separates from the differential gear, thereby causing the gear train to be in the transmission release state.

10. The image forming apparatus according to claim 9, further comprising a spring configured to press the movement member located at the first position toward the second position.

11. The image forming apparatus according to claim 1, further comprising a main housing, wherein a reconveyance path is formed in the main housing, the sheet being conveyed from the fixing device toward the photosensitive drum through the reconveyance path; and wherein the conveyance roller is located at the reconveyance path.

12. The image forming apparatus according to claim 1, wherein the cam extends in a movement direction of the cam;

wherein the cam has one surface and an other surface facing toward an opposite direction from the one surface along a crossing direction crossing the movement direction;

wherein the one surface has a groove;

wherein the image forming apparatus further includes a lever mechanism configured to move, in conjunction with movement of the cam, between:

a pressing release position at which a part of the lever mechanism fits in the groove and causes the development roller to be located at the contact position; and a pressing position at which the part of the lever mechanism does not fit in the groove and causes the development roller to be located at the separation position;

wherein the other surface has a plurality of cam surfaces; and wherein the movement member is movable between the first position and the second position by contacting the plurality of cam surfaces.

13. The image forming apparatus according to claim 1, wherein the movement member is a lever which is rotationally movable about an axis.

14. The image forming apparatus according to claim 1, wherein the movement member includes a gear tooth configured to engage the gear train to cause the gear train to be in the transmission state and to separate from the gear train to cause the gear train to be in the transmission release state.

15. The image forming apparatus according to claim 1, wherein the gear train includes:

a first idle gear rotatable by receiving power from the motor;

a differential gear including a first gear, a second gear, a third gear, and a planetary gear mechanism, the planetary gear mechanism including a sun gear, a planetary carrier, and a ring gear, the first gear being rotatable together with the sun gear of the planetary gear mechanism, the first gear engaging with the first idle gear, the second gear being rotatable together with the planetary carrier of the planetary gear mechanism, the third gear being rotatable together with the ring gear of the planetary gear mechanism; and a second idle gear engaging with the second gear of the differential gear, the second idle gear being configured to transmit power to the conveyance roller;

wherein, when the movement member engages with the third gear of the differential gear, rotation of the third gear is stopped and the second gear rotates together with the first gear, thereby causing the gear train to be in the transmission state; and wherein, when the movement member separates from the third gear of the differential gear, rotation of the third gear is allowed and the rotation of the second gear is stopped, thereby causing the gear train to be in the transmission release state.

* * * * *